US007730623B2

(12) United States Patent
Lien

(10) Patent No.: US 7,730,623 B2
(45) Date of Patent: Jun. 8, 2010

(54) FRAME JAMB MARKER

(76) Inventor: Chin-Hsiung Lien, 11561 Hallwood Dr., El Monte, CA (US) 91732

( * ) Notice: Subject to any disclaimer, the term of this patent is extended or adjusted under 35 U.S.C. 154(b) by 0 days.

(21) Appl. No.: 12/283,322

(22) Filed: Sep. 9, 2008

(65) Prior Publication Data

US 2009/0071021 A1 Mar. 19, 2009

Related U.S. Application Data

(60) Provisional application No. 60/994,289, filed on Sep. 17, 2007.

(51) Int. Cl.
*E05B 17/06* (2006.01)

(52) U.S. Cl. ..... 33/197; 33/194; 33/42

(58) Field of Classification Search ..... 33/194, 33/197, 528, 562, 563, 566, 567, 574, 429, 33/448, 474, 476, 479, 481, 613, 645, 41.1, 33/41.6, 42, DIG. 10, 578, 579; D10/64
See application file for complete search history.

(56) References Cited

U.S. PATENT DOCUMENTS 343,616 A * 6/1886 Upson et al. ..... 33/474
387,966 A * 8/1888 Beckwith ..... 33/429
1,045,871 A * 12/1912 Miller ..... 33/197
1,135,259 A * 4/1915 Cokely ..... 33/481
1,196,213 A * 8/1916 Dau ..... 33/42
2,634,507 A * 4/1953 Boatwright ..... 33/197
3,169,320 A * 2/1965 Currie ..... 33/429
4,361,964 A * 12/1982 Hennessee ..... 33/478
5,123,172 A * 6/1992 Thrun ..... 33/526
6,272,758 B1 * 8/2001 Wheeler ..... 33/1 G
6,532,674 B2 * 3/2003 Farese ..... 33/194

* cited by examiner

*Primary Examiner*—Amy Cohen Johnson
(74) *Attorney, Agent, or Firm*—Raymond Y. Chan; David and Raymond Patent Firm

(57) ABSTRACT

A frame jamb marker includes a sliding panel for sliding on the side surface of the frame and a guiding panel perpendicularly extended from the sliding panel for sliding on the marking surface of the frame, wherein the guiding panel has a top stepping edge and a bottom stepping edge to define a top marking point and a bottom marking point at stepping corners at the top and bottom stepping edges respectively. The user is able to point a marker tool on the marking surface at one of the top and bottom marking points. When the sliding panel is slid on the side surface to drive the guiding panel sliding on the marking surface, the marker tool is guided to slidably mark on the marking surface to make a straight marking line thereon so as to precisely form the marking line parallel to the common edge of the frame.

10 Claims, 5 Drawing Sheets

FRAME JAMB MARKER

CROSS REFERENCE OF RELATED APPLICATION

This is a non-provisional application of a provisional application having an application No. 60/994,289 and a filing date of Sep. 17, 2007.

BACKGROUND OF THE PRESENT INVENTION

1. Field of Invention

The present invention relates to a frame jamb marker, more particularly to a frame jamb marker, which comprises sliding panel as a reference for sliding on a side surface of a frame and a guiding panel having a marking point, wherein a user is able to point a marker tool on the marking surface of the frame at the marking point, such that when the sliding panel is slid on the side surface of the frame to drive the guiding panel to slid on the marking surface, the marker tool is guided to slidably mark on the marking surface to make a straight marking line thereon so as to precisely form the marking line parallel to said common edge of said frame.

2. Description of Related Arts

A ruler or rule is a common tool used in our daily life to measure the distance and straight lines. Generally there are two types of rulers: straight rule and retractable flexible rule. However, no matter which type of the ruler is, the ruler still has its drawbacks.

The straight rule is a device which draws the straight line by means of its side boundary. Because the structure is simple and the weight is light, it is very common for people to use in their office. However, the straight line people need to draw is usually long. In other words, when the straight rule is not long enough, the user must move down the straight rule to continue on its drawing on the straight line. It is no doubt increasing the chance to draw a sloping line. So there are still several sizes of straight rule to meet the user need in responsive to the different length of the straight line. Moreover, even though the user finds a long straight rule to draw or to measure a straight line, the straight rule is hard to carry, no mention to find a place to storage it.

On the other hand, the retractable flexible rule is another device mainly to the measuring usage. As compared to a straight rule, the retractable flexible rule is able to measuring the longest item, and is also flexible in its size when finish using. However, owing to the material of the retractable flexible is usually full of elastic but not solid; people often use it for measuring the distance between points, not drawing the straight lines.

Nowadays, people put more emphasis on their standard of the living; they usually remodel their housing to make their quality of life improve dramatically. Among them, remodeling the door frame and changing the picture frame are good methods. To sum up how to precisely draw the marking line parallel to the common edge of the frame and meet the different needs of common edge are the most important issue to deal with the frame change.

SUMMARY OF THE PRESENT INVENTION

The main object of the present invention is to provide a frame jamb marker, wherein a user is able to precisely draw the marking line parallel to the common edge of the frame.

Another object of the present invention is to provide a frame jamb marker, which comprises sliding panel as a reference for sliding on a side surface of a frame and a guiding panel having a marking point, such that a user is able to point a marker tool on the marking surface of the frame at the marking point to draw the making line of the marking surface of the frame.

Another object of the present invention is to provide a frame jamb marker, wherein the first portion height is larger than the second portion height, such that the user is able to draw two marking lines corresponding to two side surfaces of the frame so as to ensure the two marking lines being drawn perpendicular intersected at right angle.

Another object of the present invention is to provide a frame jamb marker, wherein the first portion height is from in ladder shape and is available in six thicknesses from ⅛ to ⅔ inch so as to meet the different needs of common edge.

Accordingly, in order to accomplish the above objects, the present invention provides a frame jamb marker for a frame having a side surface perpendicularly extended from a marking surface along a common edge, wherein the frame jamb mark comprises:

a sliding panel adapted for being slid on the side surface of the frame; and a guiding panel perpendicularly extended from the sliding panel for being driven to slide on the marking surface when the sliding panel is slid on the side surface, wherein the guiding panel has a top stepping edge and a bottom stepping edge to define at least a top marking point and at least a bottom marking point at stepping corners at the top and bottom stepping edges respectively.

Therefore, a user is able to point a marker tool on the marking surface at one of the top and bottom marking points, such that when the sliding panel is slid on the side surface of the frame to drive the guiding panel to slid on the marking surface, the marker tool is guided to slidably mark on the marking surface to make a straight marking line thereon so as to precisely form the marking line parallel to the common edge of the frame.

These and other objectives, features, and advantages of the present invention will become apparent from the following detailed description, the accompanying drawings, and the appended claims.

DETAILED DESCRIPTION OF THE PREFERRED EMBODIMENT

Figure 1:
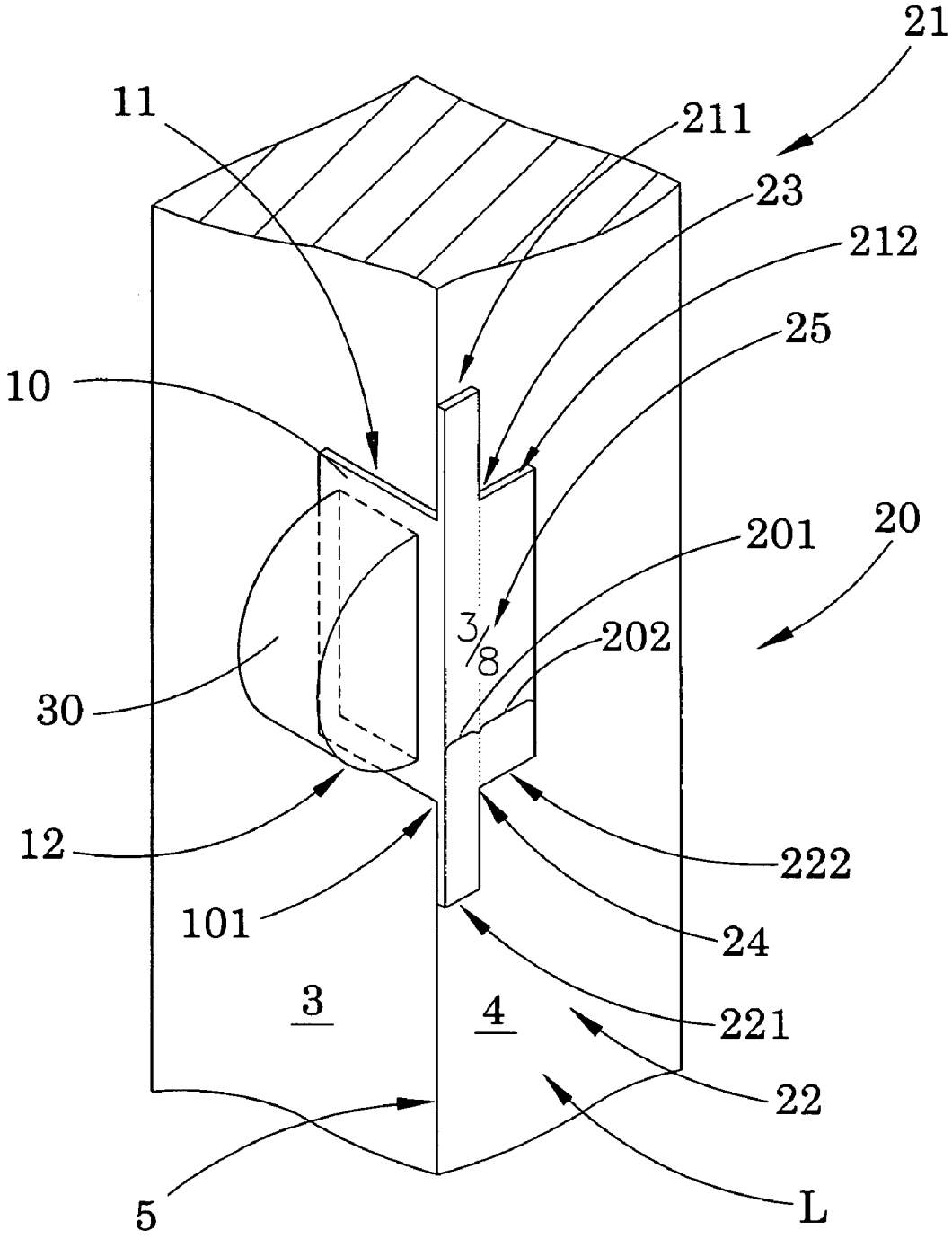
FIG. 1 is a perspective view of a frame jamb marker according to a preferred embodiment of the present invention.
Figure 2:
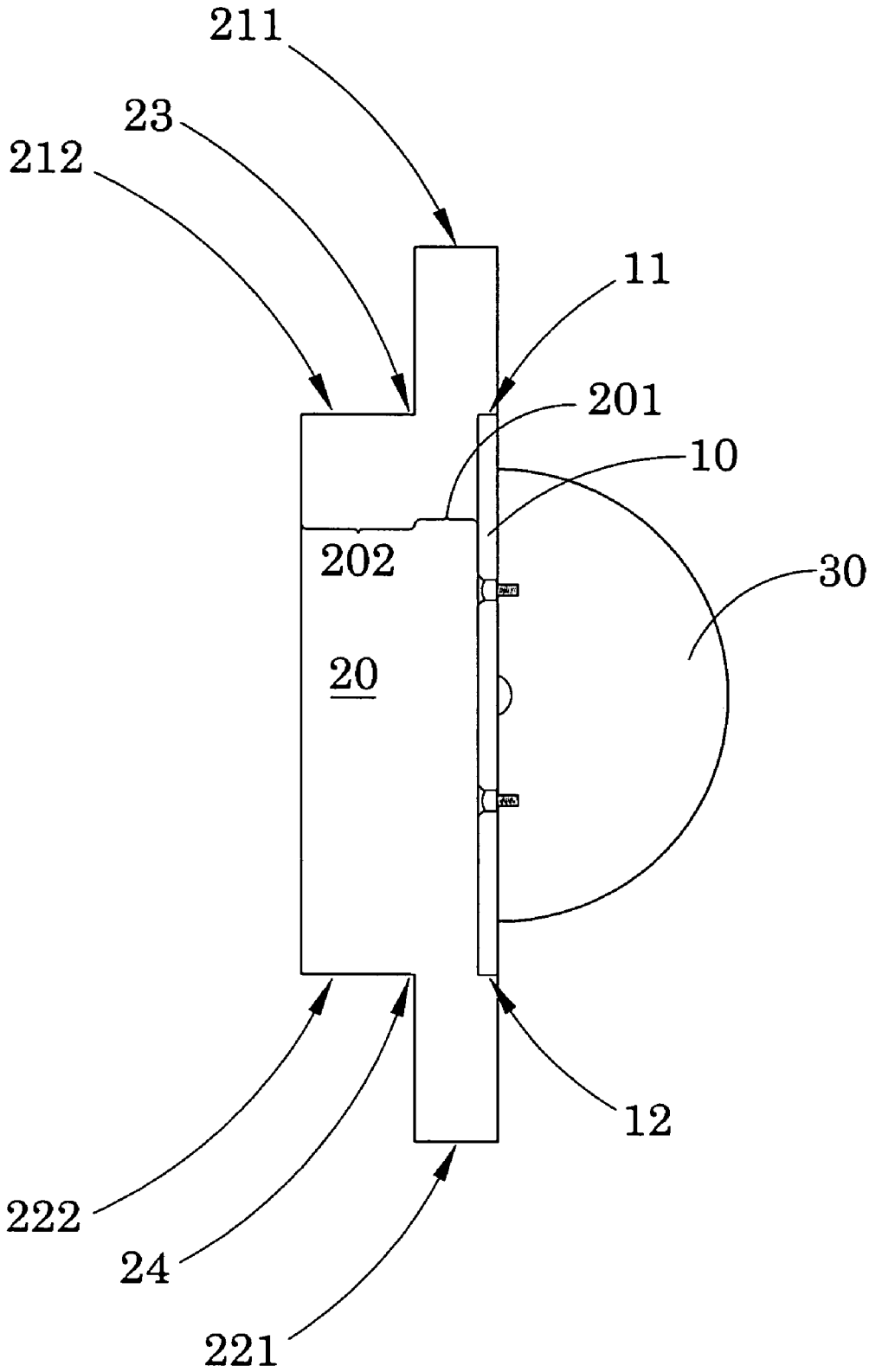
FIG. 2 is a side view of the frame jamb marker according to the preferred embodiment of the present invention.
Figure 3:
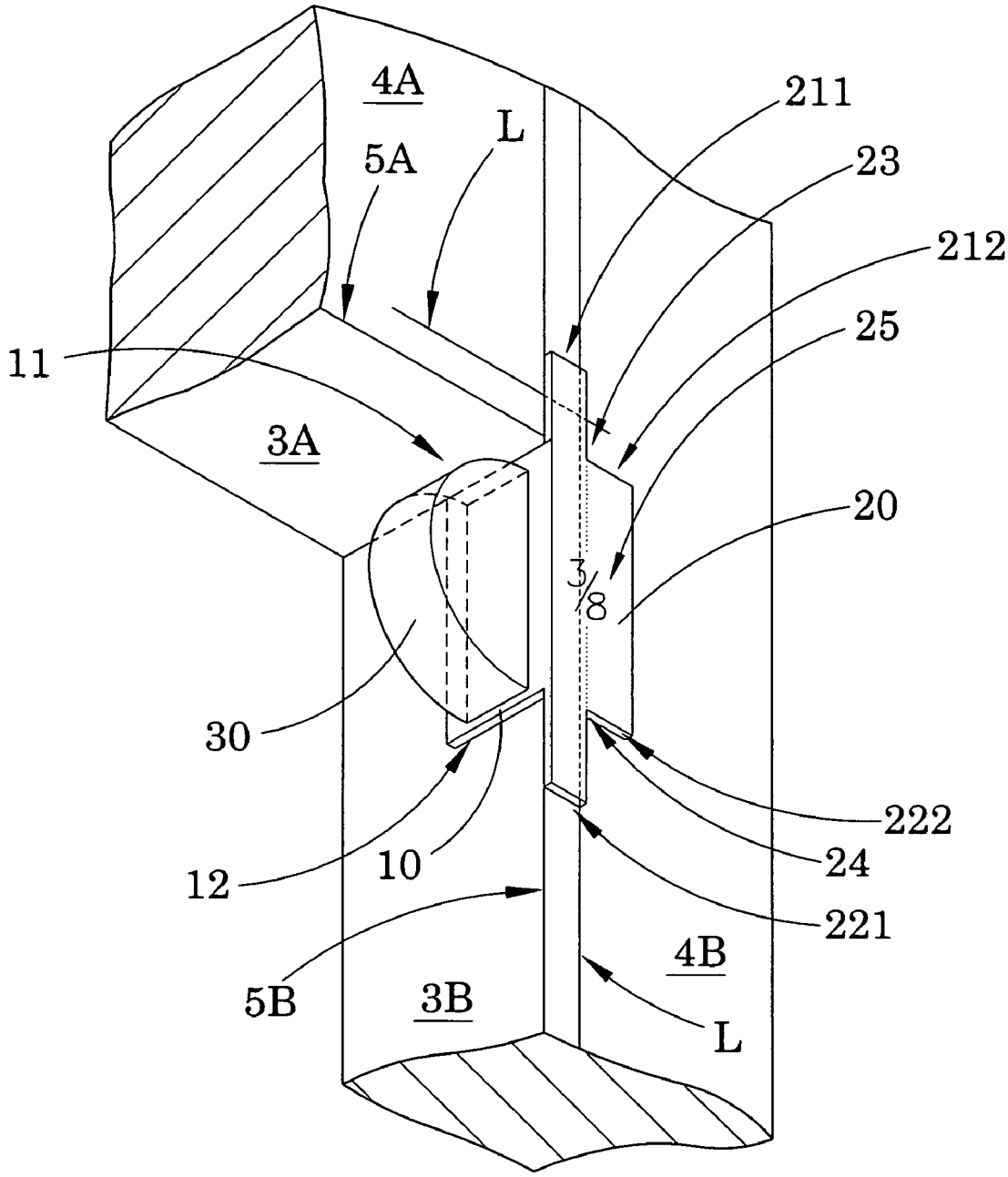
FIG. 3 illustrates the frame jamb marker located at the frame according to the above preferred embodiment of the present invention, illustrating the intersection of two marking lines.

Referring to FIG. 1 to FIG. 3 of the drawings, a frame jamb marker according to a preferred embodiment of the present invention is illustrated, wherein a frame jamb marker is used as a marking tool for a frame such as a door frame or a window frame. Accordingly, the frame has at least a side surface 3 perpendicularly extended from a marking surface 4 along a common edge 5. In other words, the door frame has three side surfaces and three marking surfaces while the window frame has four side surfaces and four marking surfaces.

The frame jamb marker comprises a sliding panel 10 adapted for being slid on the side surface 3 of the frame and a guiding panel 20 perpendicularly extended from the sliding panel 10 for being driven to slide on the marking surface 4 when the sliding panel 10 is slid on the side surface 3. In other words, the sliding panel 10 and the guiding panel 20 form a L-shaped surface slider that a common guiding edge 101 between the sliding panel 10 and the guiding panel 20 is aligned with the common edge 5 of the frame.

According to the preferred embodiment, the guiding panel 20 has a top stepping edge 21 and a bottom stepping edge 22 to define at least a top marking point 23 and at least a bottom marking point 24 at stepping corners at the top and bottom stepping edges 21, 22 respectively.

Therefore, a user is able to point a marker tool on the marking surface 4 at one of the top and bottom marking points 23, 24, such that when the sliding panel 10 is slid on the side surface 3 of the frame to drive the guiding panel 20 to slid on the marking surface 4, the marker tool is guided to slidably mark on the marking surface 4, to make a straight marking line L thereon so as to precisely form the marking line L parallel to the common edge 5 of the frame.

Accordingly, the guiding panel 20 comprises a first guiding portion 201 defining a first step portion 211, 221 of each of the top stepping edge 21 and the bottom stepping edge 22 and a second guiding portion 202 defining a second step portion 212, 222 of each of the top stepping edge 21 and the bottom stepping edge 22, wherein a length of the first guiding portion 201 is longer than a length of the second guiding portion 202. In other words, the first step portion 211 of the top stepping edge 21 is positioned above the second step portion 212 of the top stepping edge 21 to form a stepping structure of the top stepping edge 21. Likewise, the first step portion 221 of the bottom stepping edge 22 is positioned below the second step portion 222 of the bottom stepping edge 22 to form a stepping structure of the bottom stepping edge 22. Accordingly, each of the top and bottom stepping edges 21, 22 has a L-shape configuration to define the stepping corners thereof.

In addition, the second step portions 212, 222 of the top and bottom stepping edges 21, 22 are aligned with top and bottom edges 11, 12 of the sliding panel 10 respectively. In other words, the first step portion 211 of the top stepping edge 21 is positioned above the top edge 11 of the sliding panel 10 while the first step portion 212 of the bottom stepping edge 21 is positioned below the bottom edge 12 of the sliding panel 10. It is worth to mention that the first and second step portions 211, 212 of the top stepping edge 21 are extended horizontally and parallel to the top edge 11 of the sliding panel 10 while the first and second step portions 221, 222 of the bottom stepping edge 22 are extended horizontally and parallel to the bottom edge 12 of the sliding panel 10.

In order to draw the straight line L on the marking surface 4 of the frame with a predetermined distance from the common edge 5 thereof, a width of the first guiding portion 201 of the guiding panel 20 is pre-configured. Accordingly, the width of the first guiding portion 201 of the guiding panel 20 is pre-configured as ⅛ inch, ¼ inch, ⅜ inch, ½ inch, or ⅝ inch. In other words, the straight line L on the marking surface 4 of the frame with the distance from the common edge 5 thereof from ⅛ inch, ¼ inch, ⅜ inch, ½ inch, or ⅝ inch corresponding to the width of the first guiding portion 201 of the guiding panel 20.

The guiding panel 20 further contains a mark indicator 25 marked on the guiding panel 20 to indicate the width of the first guiding portion 201 of the guiding panel 20. In other words, the mark indicator 25 indicates the distance between the common guiding edge 101 and each of the top and bottom marking points 23, 24 to indicate the distance between the common edge 5 of the frame and the straight line L.

As shown in FIG. 2, the top marking point 23 is defined at the stepping corner of the L-shaped top stepping edge 21 wherein the top marking point 23 is formed at the second step portion 212 of the top stepping edge 21 adjacent to the first step portion 211 thereof Likewise, the bottom marking point 24 is defined at the stepping corner of the L-shaped bottom stepping edge 22 wherein the bottom marking point 24 is formed at the second step portion 222 of the bottom stepping edge 22 adjacent to the first step portion 221 thereof.

As shown in FIGS. 1 to 3, the frame jamb marker further comprises a driving handle 30 affixed to the sliding panel 10 to drive the sliding panel 10 sliding on the side surface 3 of the frame. Accordingly, the user is able to hold the driving handle 30 to place the sliding panel 10 on the side surface 3 of the frame to retain the guiding panel 20 being placed on the marking surface 4 of the frame.

As shown in FIG. 3, in order to draw the straight marking line L on the marking surface 4 of the frame, the user is able to locate the frame jamb marker at the corner of the frame in which two side surfaces 3 of the frame are intersected. For example, the user plans to draw the straight marking line L at the door frame having the horizontal (top) frame section defining the horizontal side surface 3A, horizontal marking surface 4A, and horizontal common edge 5A, and the vertical (side) frame section defining the vertical side surface 3B, vertical marking surface 4B, and vertical common edge 5B.

Accordingly, the user is able to hold the frame jamb marker at the position that the sliding panel 10 is pressed on the vertical side surface 3B that the top edge 11 of the sliding panel 10 is biased against the horizontal side surface 3B. At this position, the first step portion 211 of the top guiding edge 21 of the guiding panel 20 is positioned above the horizontal side surface 3B. Therefore, the user is able to draw the vertical marking line L on the vertical marking surface 4B above the horizontal side surface 3B. It is very useful the vertical marking line L on the vertical marking surface 4B is drawn to intersect with the horizontal marking line L on the horizontal marking surface 4A.

The user is able to put the marker tool, such as a pen or a pencil, at the top marking point 23 of the guiding panel 20 on the vertical marking surface 4B. Then, when the sliding panel 10 is slid on the vertical side surface 3A, the guiding panel 20 is driven to slide on the vertical marking surface 4B such that the user is able to follow the movement of the top marking point 23 of the guiding panel 20 to form the vertical marking line L on the vertical marking surface 4B precisely.

Likewise, the user is able to draw the precisely horizontal marking line L on the horizontal marking surface 4A. It is worth to mention that the vertical marking line L on the vertical marking surface 4B will perfectly intersect with the horizontal marking line L on the horizontal marking surface 4A via the L-shaped top and bottom stepping edges 21, 22 of the guiding panel 20.

Figure 4:
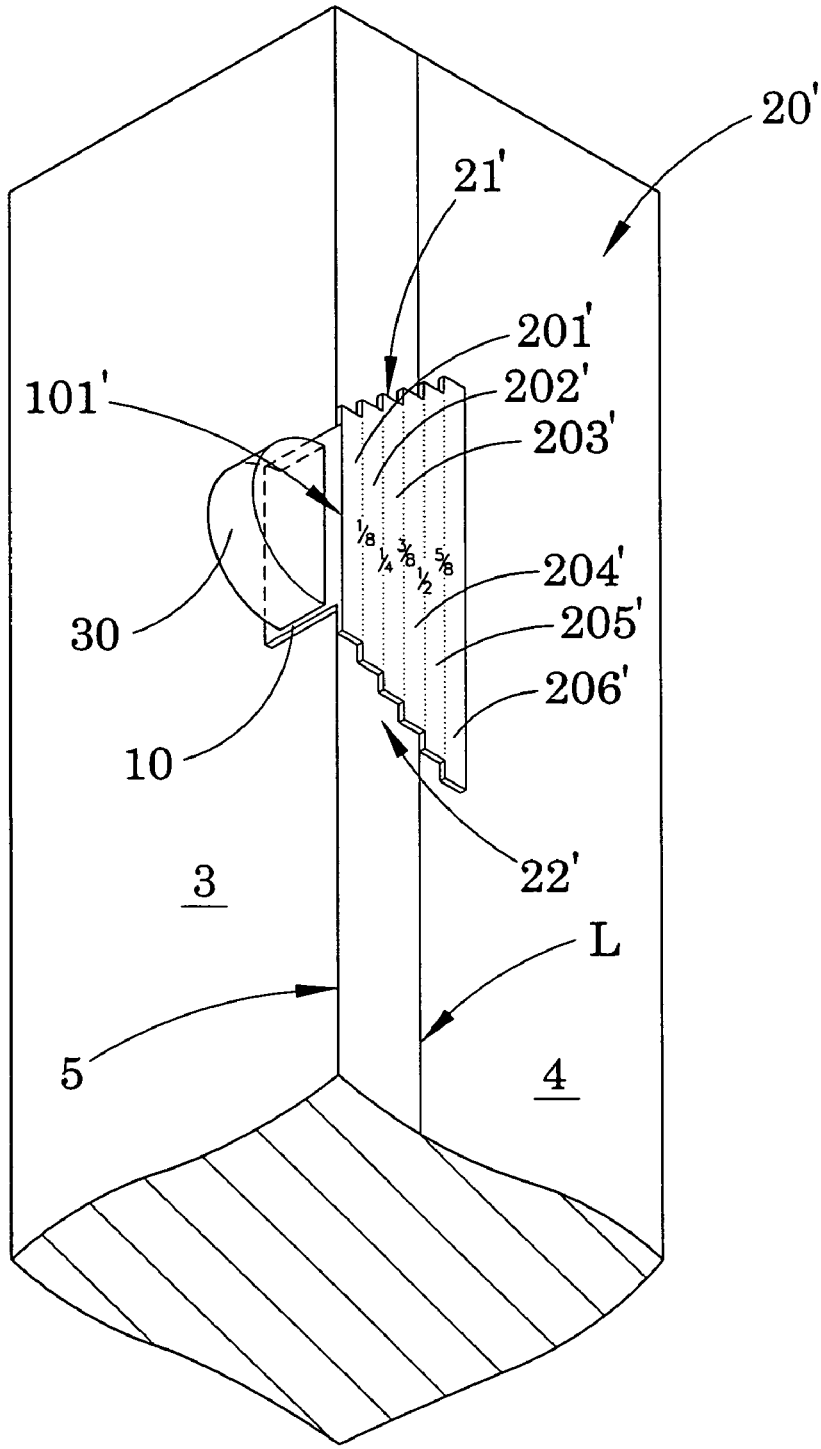
FIG. 4 illustrates an alternative mode of the frame jamb marker according to the above preferred embodiment of the present invention.
Figure 5:
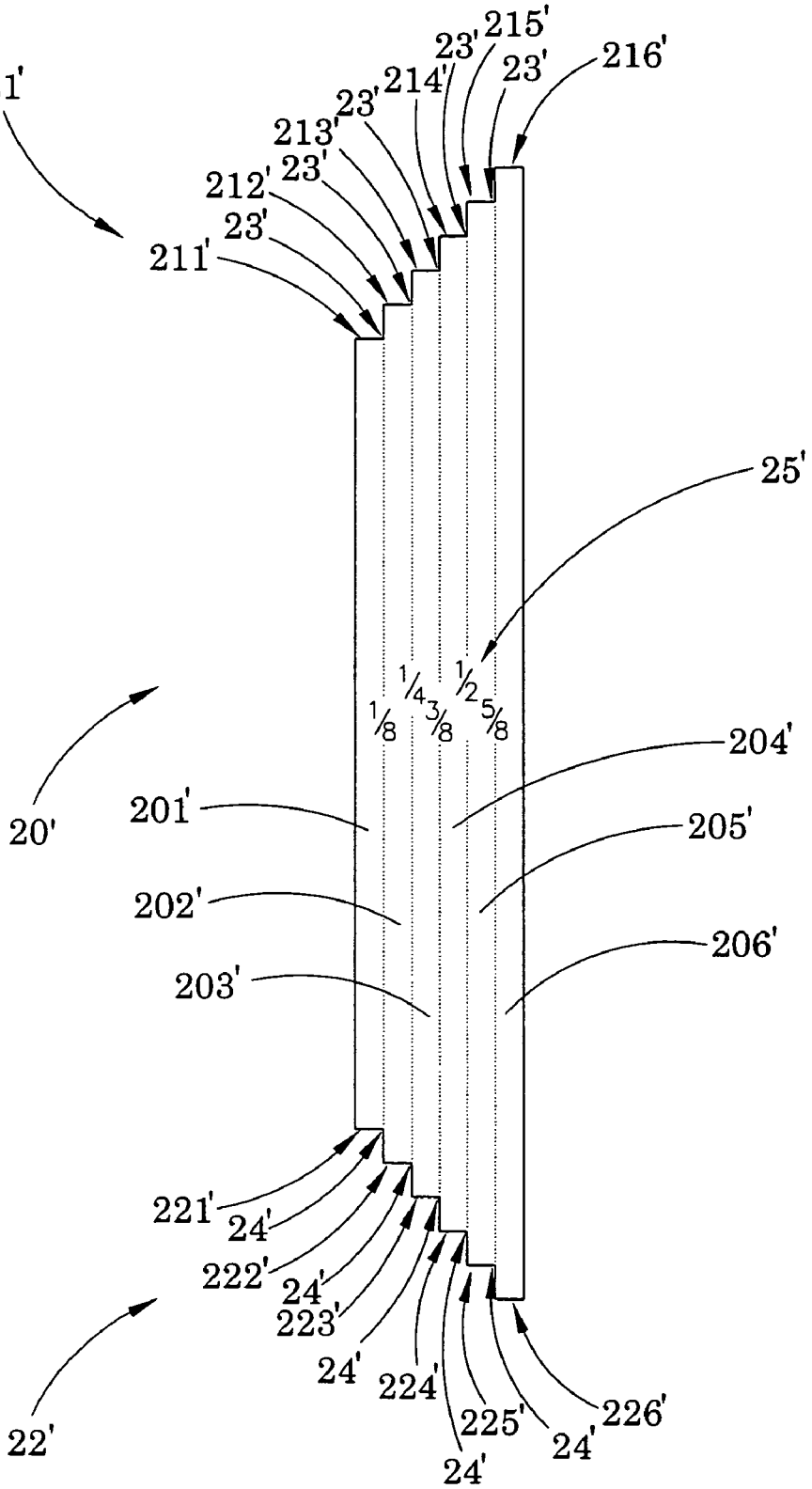
FIG. 5 illustrates the alternative mode of the sliding panel of the frame jamb marker according to the above preferred embodiment of the present invention.

FIGS. 4 and 5 illustrate an alternative mode of the guiding panel 20' of the present invention. The guiding panel 20 comprises a plurality of guiding portions defining a plurality of step portions of top and bottom stepping edges 21', 22'. As shown in FIG. 5, the guiding panel 20' contains first to sixth guiding portions 201' to 206' defining six step portions 211' to 216' of the top stepping edge 21' and six step portions 221' to 226' of the bottom stepping edge 22'. Each portion of the top and bottom stepping edges 21', 22' also has the L-shaped configuration to define the stepping corners thereof.

In other words, the first guiding portion 201' of the guiding panel 20' defines the first step portions 211', 221' of the top and bottom stepping edges 21', 22'. The second guiding portion 202' of the guiding panel 20' defines the second step portions 212', 222' of the top and bottom stepping edges 21', 22'. The third guiding portion 203' of the guiding panel 20' defines the third step portions 213', 223' of the top and bottom stepping edges 21', 22'. The fourth guiding portion 204' of the guiding panel 20' defines the fourth portions 214', 224' of the top and bottom stepping edges 21', 22'. The fifth guiding portion 205' of the guiding panel 20' defines the fifth step portions 215', 225' of the top and bottom stepping edges 21', 22'. The sixth guiding portion 201' of the guiding panel 20' defines the sixth step portions 216', 226' of the top and bottom stepping edges 21', 22'. Therefore, the top stepping edge 21' of the guiding panel 20' forms a stepping structure through the first to sixth step portions 211' to 216' of the top stepping edge 21', while the bottom stepping edge 22' of the guiding panel 20' forms a stepping structure through the first to sixth step portions 221' to 226' of the bottom stepping edge 22'.

Accordingly, the length of the first guiding portion 201' of the guiding panel 20' is shorter than the length of the second guiding portion 202' of the guiding panel 20'. Likewise, the length of the second guiding portion 202' of the guiding panel 20' is shorter than the length of the third guiding portion 203' of the guiding panel 20'. The length of the third guiding portion 203' of the guiding panel 20' is shorter than the length of the fourth guiding portion 204' of the guiding panel 20'. The length of the fourth guiding portion 204' of the guiding panel 20' is shorter than the length of the fifth guiding portion 205' of the guiding panel 20'. The length of the fifth guiding portion 205' of the guiding panel 20' is shorter than the length of the sixth guiding portion 206' of the guiding panel 20'.

In addition, the first step portion 211' of the top stepping edge 21' is positioned above the top edge 11 of the sliding panel 10 while the first step portion 221' of the bottom stepping edges 22' is positioned below the bottom edge 12 of the sliding panel 10.

In other words, the horizontal levels of the step portions 211' to 216' of the top stepping edge 21' is gradually elevating from the common guiding edge 101' of the guiding panel 20' to an outer edge thereof while the horizontal levels of the step portions 221' to 226' of the bottom stepping edge 22' is gradually descending from the common guiding edge 101' of the guiding panel 20' to the outer edge thereof. In particularly, all the first to six step portions 211' to 216' of the top stepping edge 21' are positioned above the top edge 11 of the sliding panel 10 while all the first to six step portions 221' to 226' of the bottom stepping edge 22' are positioned below the bottom edge 11 of the sliding panel 10. It is worth to mention that the first to six step portions 211' to 216' of the top stepping edge 21' are extended horizontally and parallel to the top edge 11 of the sliding panel 10. The first to six step portions 221' to 226' of the bottom stepping edge 22' are extended horizontally and parallel to the bottom edge 12 of the sliding panel 10.

In other words, the first step portion 211' of the top stepping edge 21' is positioned above the top edge 11' of the sliding panel 10 while the first step portion 211' of the bottom stepping edge 22' is positioned below the bottom edge 12 of the sliding panel 10.

As shown in FIG. 5, the guiding panel 20' contains five top marking points 23' and five bottom marking points 24'. The top marking points 23' are defined at the stepping corners of the top stepping edge 21' while the bottom marking point 24' are defined at the stepping corners of the bottom stepping edge 22'. Accordingly, an outer edge of the guiding panel 20' forms a guiding edge as well to guide the user drawing the straight marking line L at the outer edge of the guiding panel 20'.

According to the preferred embodiment, a width of the first guiding portion 201' of the guiding panel 20' is ⅛ inch, i.e. the distance between the common guiding edge 101' and the first marking point 23', 24', to form the straight marking line L with a distance ⅛ inch away from the common edge 5 of the frame. A distance between the common guiding edge 101' and the second marking point 23', 24', i.e. the total width of first and second guiding portions 201', 202', is ¼ inch to form the straight marking line L with a distance ¼ inch away from the common edge 5 of the frame. A distance between the common guiding edge 101' and the third marking point 23', 24', i.e. the total width of first to third guiding portions 201' to 203', is ⅜ inch to form the straight marking line L with a distance ⅜ inch away from the common edge 5 of the frame. A distance between the common guiding edge 101' and the fourth marking point 23', 24', i.e. the total width of first to fourth guiding portions 201' to 204', is ½ inch to form the straight marking line L with a distance ½ inch away from the common edge 5 of the frame. A distance between the common guiding edge 101' and the fifth marking point 23', 24', i.e. the total width of first to fifth guiding portions 201' to 205', is ⅝ inch to form the straight marking line L with a distance ⅝ inch away from the common edge 5 of the frame.

The guiding panel 20' further contains five mark indicators 25' spacedly marked on the guiding panel 20' to indicate the width of the first to fifth guiding portion 201' to 205' of the guiding panel 20'.

Therefore, the user is able to draw the straight marking lines L with different distances and to intersect with another straight marking line L as it is mentioned above.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A frame jamb marker for a frame having a side surface perpendicularly extended from a marking surface along a common edge, wherein the frame jamb mark comprises:

a sliding panel adapted for being slid on said side surface of said frame; and a guiding panel perpendicularly extended from said sliding panel along a common guiding edge for being driven to slide on said marking surface when said sliding panel is slid on said side surface, wherein said guiding panel has a top stepping edge at a topmost edge of said guiding panel, and a bottom stepping edge at a bottommost edge of said guiding panel defining at least a top marking point and at least a bottom marking point at stepping corners at said top and bottom stepping edges respectively, wherein said guiding panel comprises a first guiding portion and a second guiding portion having a length shorter than a length of said first guiding portion, wherein said top stepping edge has a first step portion defined at a top edge of said first guiding portion and a second step portion defined at a top edge of said second guiding portion, wherein said bottom stepping edge has a first step portion defined at a bottom edge of said first guiding portion and a second step portion defined at a bottom edge of said second guiding portion, wherein said second step portions of said top and bottom stepping edges are aligned with top and bottom edges of said sliding panel respectively, thereby, a user is able to point a marker tool on the marking surface at one of said top and bottom marking points, such that when said sliding panel is slid on said side surface of said frame to drive said guiding panel to slid on said marking surface, said marker tool is guided to slidably mark on said marking surface to make a straight marking line thereon so as to precisely form said marking line parallel to said common edge of said frame.

2. The frame jamb marker, as recited in claim 1, wherein said guiding panel further contains a mark indicator which is marked on said guiding panel and is indicating a distance between said common guiding edge and each of said top and bottom marking points for indicating a distance between said common edge of said frame and said straight line.

3. The frame jamb marker, as recited in claim 2, wherein each of said top and bottom stepping edges has a L-shaped configuration that said top and bottom marking points are formed at corners of said top and bottom stepping edges respectively.

4. The frame jamb marker, as recited in claim 3, wherein said first and second step portions of said top stepping edge are extended horizontally and parallel to said top edge of said sliding panel while said first and second step portions of the bottom stepping edge are extended horizontally and parallel to said bottom edge of said sliding panel.

5. The frame jamb marker, as recited in claim 4, further comprising a driving handle affixed to said sliding panel to drive said sliding panel sliding on said side surface of said frame.

6. The frame jamb marker, as recited in claim 1, wherein each of said top and bottom stepping edges has a L-shaped configuration that said top and bottom marking points are formed at corners of said top and bottom stepping edges respectively.

7. The frame jamb marker, as recited in claim 6, wherein said first and second step portions of said top stepping edge are extended horizontally and parallel to said top edge of said sliding panel while said first and second step portions of the bottom stepping edge are extended horizontally and parallel to said bottom edge of said sliding panel.

8. The frame jamb marker, as recited in claim 7, further comprising a driving handle affixed to said sliding panel to drive said sliding panel sliding on said side surface of said frame.

9. A frame jamb marker for a frame having a side surface perpendicularly extended from a marking surface along a common edge, wherein the frame jamb mark comprises:

a sliding panel adapted for being slid on said side surface of said frame; and a guiding panel perpendicularly extended from said sliding panel along a common guiding edge for being driven to slide on said marking surface when said sliding panel is slid on said side surface, wherein said guiding panel has a top stepping edge at a topmost edge of said guiding panel, and a bottom stepping edge at a bottommost edge of said guiding panel defining a plurality of top marking points and a plurality of bottom marking points at stepping corners at said top and bottom stepping edges respectively, wherein said guiding panel has a plurality of guiding portions defining a plurality of portions of said top and bottom stepping edges, wherein each portion of said top and bottom stepping edges has a L-shaped configuration that said top and bottom marking points are formed at corners of said portions of said top and bottom stepping edges respectively, wherein each of said top stepping edges further has a plurality of step portions extended horizontally and parallel to a top edge of said sliding panel while said bottom stepping edges also has a plurality of step portions extended horizontally and parallel to a bottom edge of said sliding panel, wherein horizontal levels of said step portions of said top stepping edge is gradually elevating from said common guiding edge of said guiding panel to an outer edge thereof while horizontal levels of said step portions of said bottom stepping edge is gradually descending from said common guiding edge of said guiding panel to said outer edge thereof, thereby, a user is able to point a marker tool on the marking surface at one of said top and bottom marking points, such that when said sliding panel is slid on said side surface of said frame to drive said guiding panel to slid on said marking surface, said marker tool is guided to slidably mark on said marking surface to make a straight marking line thereon so as to precisely form said marking line parallel to said common edge of said frame.

10. The frame jamb marker, as recited in claim 9, further comprising a driving handle affixed to said sliding panel to drive said sliding panel sliding on said side surface of said frame.

* * * * *